US005488914A

United States Patent [19]

Ouellette

[11] Patent Number: 5,488,914

[45] Date of Patent: Feb. 6, 1996

[54] SECURITY DEVICE FOR BOXES

[76] Inventor: Jay Ouellette, Rte. 115, P.O. Box 61, Twin Mountain, N.H. 03595

[21] Appl. No.: 111,391

[22] Filed: Aug. 25, 1993

[51] Int. Cl.[6] ..... E05G 1/08

[52] U.S. Cl. ..... 109/56; 248/551; 312/245; 70/62; 109/59 R; 109/50

[58] Field of Search ..... 109/47, 45, 62, 109/50, 51, 52, 53, 54, 59 R, 56, 57; 248/551; 312/245; 70/62, 78, 79

[56] References Cited

U.S. PATENT DOCUMENTS

| | | | |
|---|---|---|---|
| 2,085,975 | 7/1937 | Hauf . | |
| 2,251,597 | 8/1941 | Paca . | |
| 2,410,475 | 11/1946 | Anderson | 109/52 |
| 2,465,057 | 3/1949 | Brandes | 109/51 |
| 3,741,132 | 6/1973 | Blower | 109/52 |
| 4,030,788 | 6/1977 | Bleeker | 70/85 |
| 4,051,790 | 10/1977 | Meditz et al. | 109/52 |
| 4,058,993 | 11/1977 | Stubbings | 70/58 |
| 4,113,332 | 9/1978 | McMaster | 109/54 |
| 4,143,927 | 3/1979 | Spear et al. | 70/58 |
| 4,249,684 | 2/1981 | Miller et al. | 109/51 |
| 4,524,904 | 6/1985 | Massé et al. | 109/45 |
| 4,577,563 | 3/1986 | Sidler | 109/52 |
| 4,600,250 | 7/1986 | Windham | 109/50 |
| 4,712,763 | 12/1987 | Leite | 70/58 |

FOREIGN PATENT DOCUMENTS

| | | | |
|---|---|---|---|
| 1233550 | 2/1967 | Germany | 312/245 |
| 2039599 | 8/1980 | United Kingdom | 109/50 |

*Primary Examiner*—Darnell M. Boucher
*Attorney, Agent, or Firm*—Lorusso & Loud

[57] ABSTRACT

The present invention provides a security device for boxes. The security device includes a cabinet device defining an enclosure for safekeeping a box containing, for example, valuable materials. The cabinet device includes side walls, a rear wall, a front wall and a bottom base. The cabinet device has an open top section into which a bottom portion of the box which is to be secured is inserted into the upper inner portion of the cabinet device. The bottom base includes a locking device for securing the cabinet onto a supporting surface such as a floor. The front wall includes a drawer removably secured to the front wall. The cabinet includes releasably interlocking devices at the upper inner portion of the walls to secure the box onto the cabinet which is secured onto a support surface such as, for example, the floor.

7 Claims, 4 Drawing Sheets

SECURITY DEVICE FOR BOXES

BACKGROUND OF THE INVENTION

1. Field of the Invention

The present invention relates to locking devices and more particularly to a new and improved security stand for protecting a box such as a tool box.

2. Description of the Prior Art

There are numerous devices in the prior art for locking or safekeeping box assembly devices.

U.S. Pat. No. 4,249,684 discloses an easily transportable, general purpose box which may be carried about by hand and then anchored to rails and locked in place. Once the lid is locked on the box, no one without a key can move the box from the anchor rails. The invention is primarily intended as a portable trunk for mounting on a truck; however, it may be used anytime that a box is to be mounted on a chassis, such as a toolbox mounted on a wheeled dolly, a toolroom shelf, or the like, for example.

U.S. Pat. No. 4,143,927 discloses the combination with a storage cabinet of a security device for removably locking it to the top of a table or counter to prevent unauthorized removal in the absence of an employee and yet to enable an employee or other authorized person to easily release it for movement from time to time or from place to place as may be expedient. The locking components are designed to be inaccessible from within or without the cabinet.

U.S. Pat. No. 4,577,563 discloses a safety box assembly comprising a safety container of the portable and carrying type, and a mounting base intended to be fastened on a supporting surface such as the floor or the wall of a room. The assembly further comprises a locking arrangement whereby the container may be released from its mounting base to be carried about, the base remaining on the supporting wall. This assembly is conceived so that only by unlocking the locking arrangement can the safety container be opened and removed from its mounting base. The assembly is also conceived so that unless the safety container is unlocked and removed from the mounting base, it is not possible to unfasten the mounting base from its supporting surface and therefore to carry the whole assembly from its selected location.

The foregoing patents as well as the following U.S. Patents are believed to exemplify the present state of the art with respect to such safe keeping devices:

U.S. Pat. No. 4,058,993

U.S. Pat. No. 2,251,597

U.S. Pat. No. 2,085,975

While such prior art devices provide improvement in the areas intended, there still exists a need for a security device for boxes which overcomes the disadvantage of the prior art devices which do not provide a security stand for protecting existing boxes and particularly existing tool boxes.

Accordingly, a principle desirable object of the present invention is to overcome the disadvantages of the prior art.

Another desirable object of the present invention is to provide a box security stand that includes bolt means for securing the stand to a floor and means for securing the box to the security stand which also includes a drawer means.

Another desirable object of the present invention is to provide a tool box security stand that includes bolt means for securing the stand to a floor and means for securing the tool box to the security stand which also includes a drawer means.

These and other desirable objects of the present invention will in part appear hereinafter and will in part become apparent after consideration of the specification with reference to the drawings and the claims.

SUMMARY OF THE INVENTION

The present invention provides a new and improved security device for boxes. The security device for boxes includes a cabinet device defining an enclosure for safekeeping a box containing, for example, valuable materials. The cabinet device includes side walls, a rear wall, a front wall and a bottom base. The cabinet device has an open top section into which a bottom portion of the box which is to be secured is inserted into the upper inner portion of the cabinet device. The bottom base includes locking means for securing the cabinet onto a supporting surface such as a floor. The front wall includes a drawer means removably secured to the front wall. The cabinet includes releasable interlocking means at the upper inner portion of the walls whereby to secure the box onto the cabinet which is secured onto a support surface such as, for example, the floor. In this manner of the security device of the invention, the box is secured and prevented from being removed.

BRIEF DESCRIPTION OF THE DRAWINGS

For a fuller understanding of the nature and desired objects of the present invention, reference should be made to the following detailed description taken in conjunction with the accompanying drawings wherein like reference characters denote corresponding parts throughout several views and wherein.

DETAILED DESCRIPTION OF PREFERRED EMBODIMENT(S)

Figure 1:
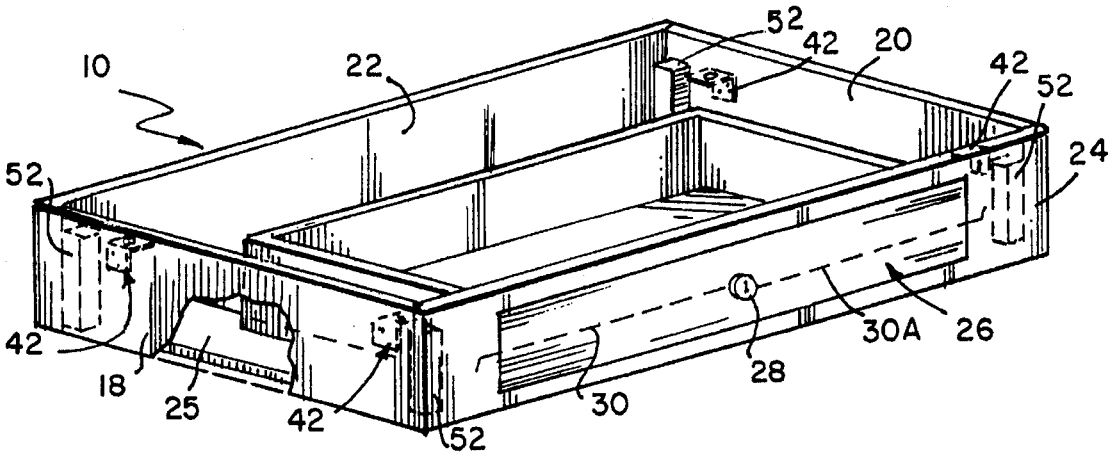
FIG. 1 is a perspective view illustrating one embodiment of a security device for boxes embodying the principles of the present invention.
Figure 2:
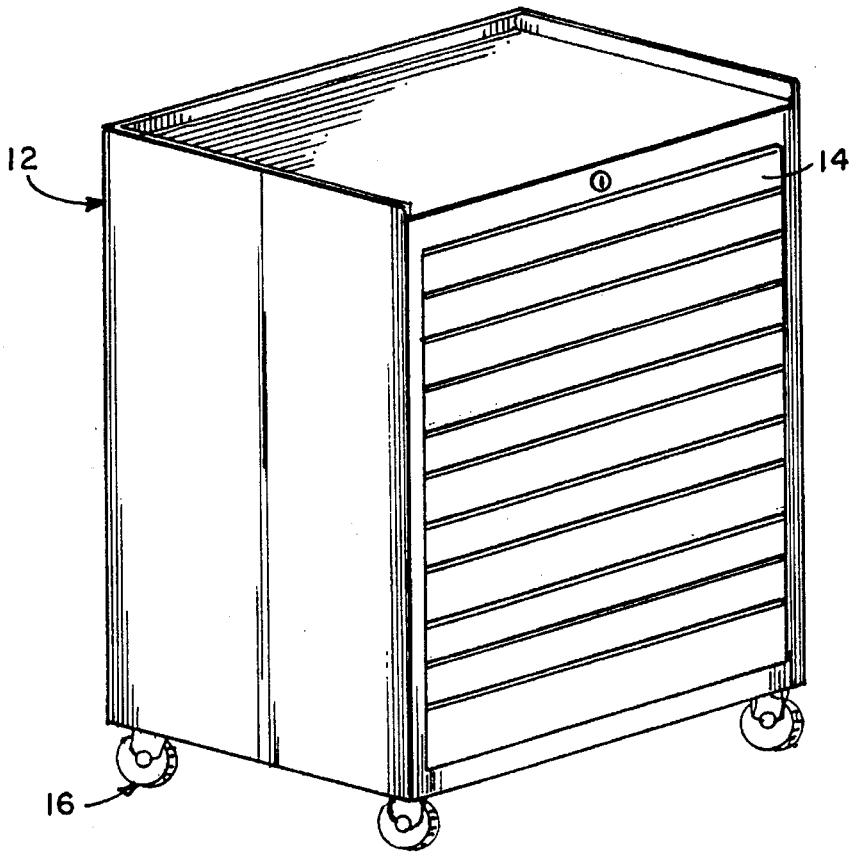
FIG. 2 is a perspective view of a tool box as an example of which can be secured and protected by the secure device of the present invention.
Figure 7:
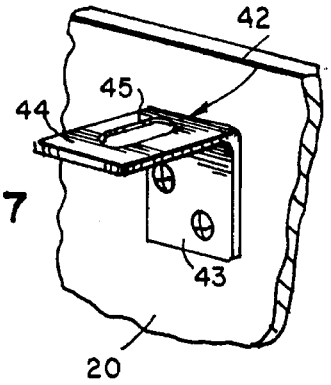
FIG. 7 is an enlarged fragmentary sectional view of the side wall with an L-bracket attached.
Figure 3:
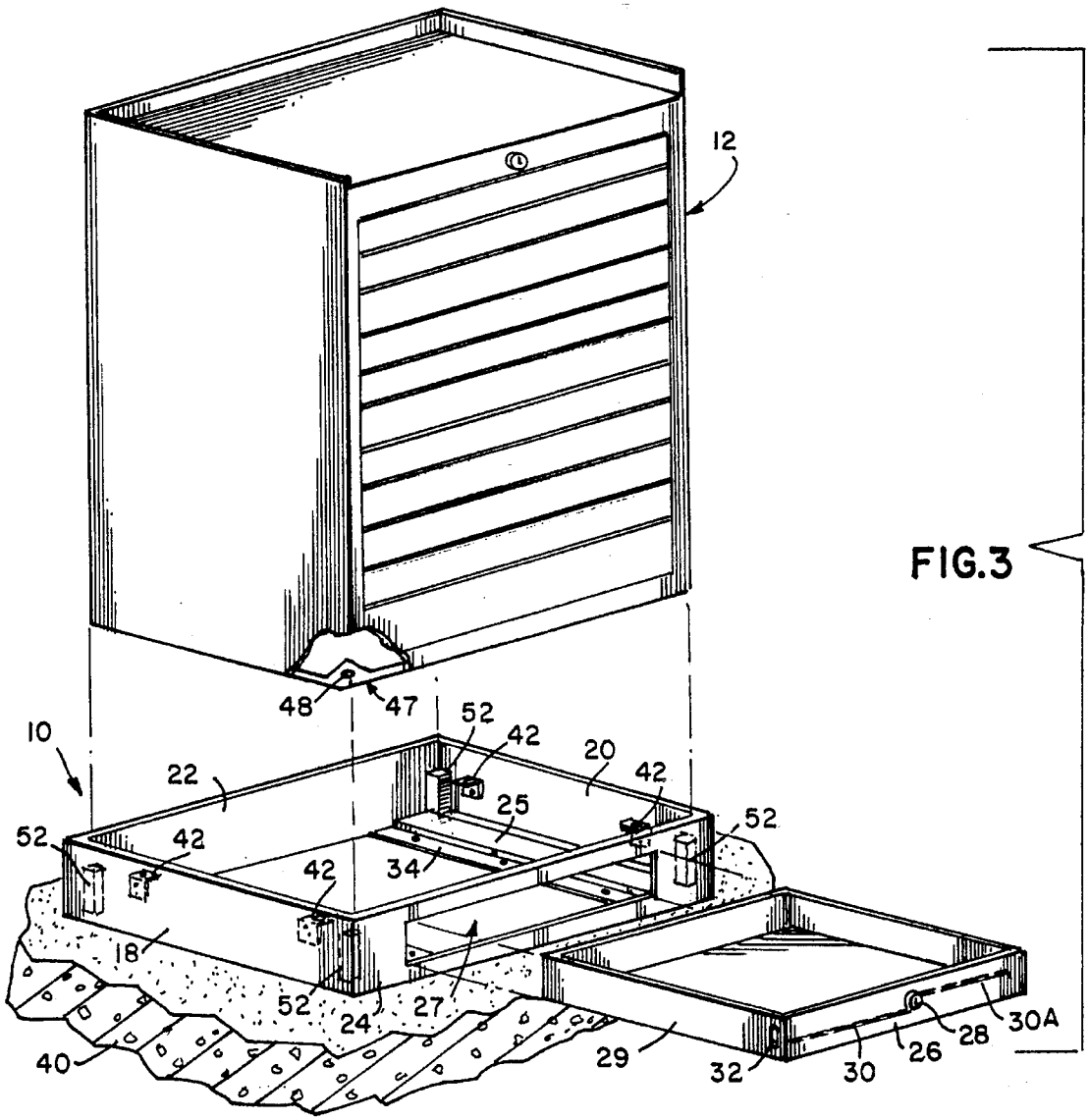
FIG. 3 is an exploded perspective view of an embodiment of the invention secure device showing in general arrangement the attaching locking system of the secure device for the tool box.

Referring now to the drawings, the present invention security device for boxes is indicated generally by the reference numeral 10. FIG. 2 illustrates a tool box 12 as one example of a box to be protected by the security device 10. In this example the tool box 12 has front drawers 14 and wheels 16 which are removed, as shown in FIG. 3, before being attached to the security device 10.

The security device 10 referred to as a cabinet device includes side walls 18 and 20, rear wall 22 and front forward wall 24. The front wall 24 includes a drawer means 26 which is insertable into the cabinet device 10 through the opening 27 of the front forward wall 24.

The drawer 26 is provided with a lock device 28 which contains two lock bars 30 and 30A which are preferably formed of metal. When the lock device 28 is turned to the left the bar 30 extends into an opening 32 on the left side 29 of the drawer 26 and the right bar 30A extends to the right into a similar opening 32A on the right side 29A of the drawer 26. In this manner the drawer 26 is locked within the security cabinet 10 to thereby prevent access within the cabinet 10.

Figure 4:
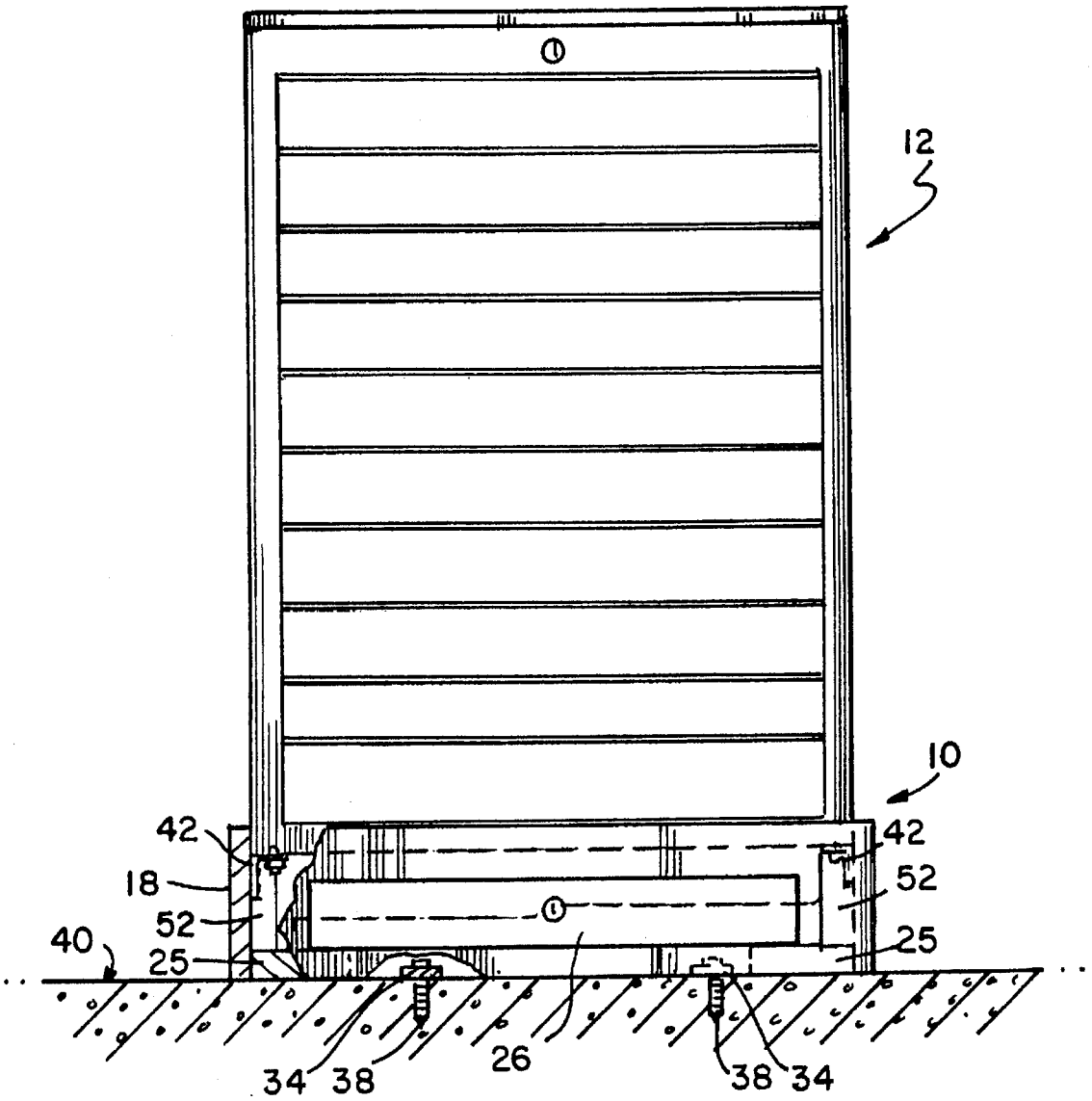
FIG. 4 is a front plan view partly in cross-section to show the locking system of the inventive secure device.
Figure 5:
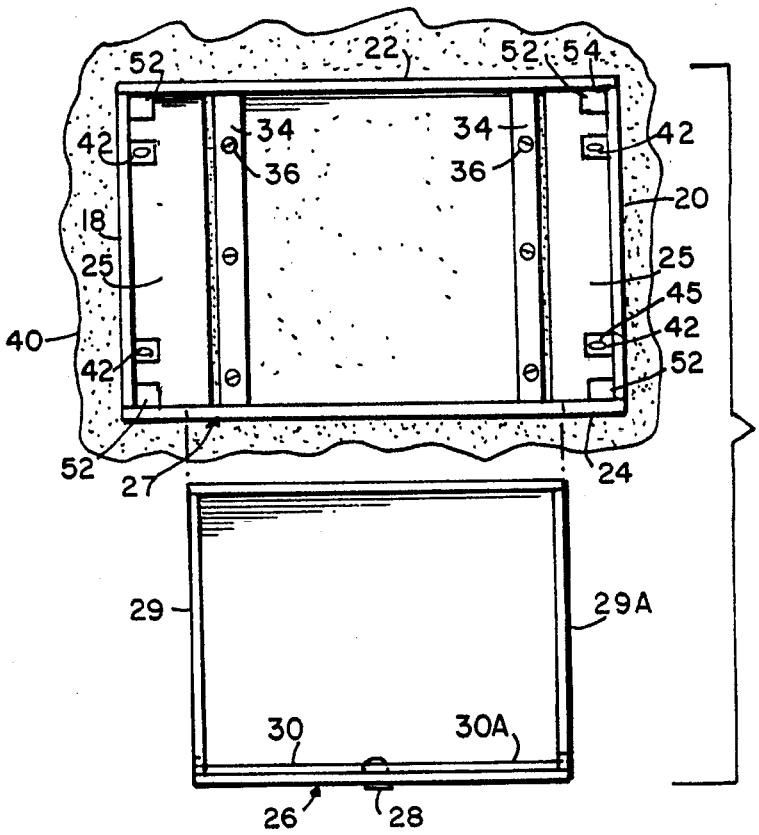
FIG. 5 is a top plan view of the secure device of FIG. 3 with the drawer means removed from the opening of the front wall.
Figure 6:
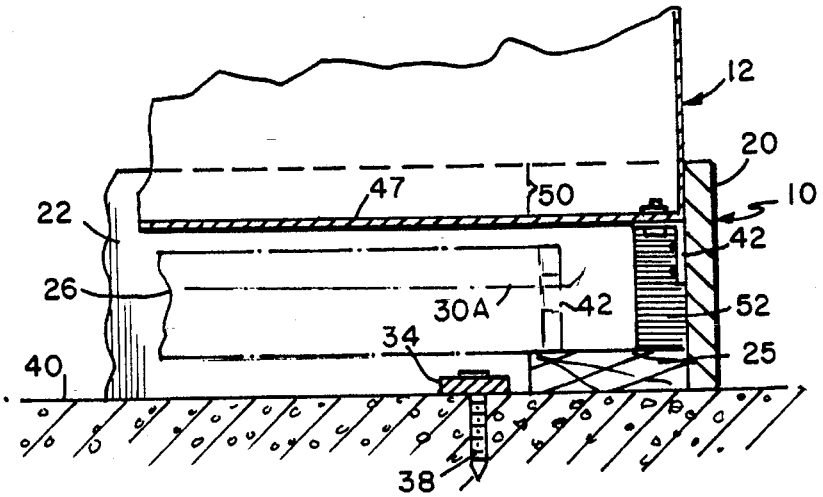
FIG. 6 is an enlarged fragmentary partial sectional view showing the method of attaching the tool box to the secure device and the secure device to the floor section.

As illustrated more particularly in FIGS. 4–6, the inner bottom portion of the cabinet device 10 is provided with lag bars 34. The lag bars 34 include holes 36 into which lag bolts 38 are inserted and attached to the floor 40. In the example illustrated the floor 40 is a cement floor into which the lag bolts 38 are screwed and thereby secure the cabinet device 10 so that it cannot be removed. This attachment can be applied to other floors formed, for example, of wood or metal.

The side walls 18 and 20 are provided with means for securing the tool box 12 within the upper section of the cabinet device 10. As indicated the side walls 18 and 20 are provided with L-brackets 42 which have a vertical section 43 which is attached to the inner side walls of the cabinet device and an upper horizontal section 44 with a hole 45 to insert a securing bolt 46. In this manner the bottom portion 47 of the tool box 12, as shown in FIG. 3, is provided with a tapped hole 48 and the tool box 12 is then set upon the L-brackets 42. Then by reaching into the front opening 27 the bolts 46 are inserted to secure the tool box 12 on and within the upper portion 50 of the security cabinet device 10.

In a preferred embodiment the cabinet device 10 is provided with support devices 52 which are attached to the corners 54 of the cabinet device 10 with a height equal to the horizontal section 44 of the L-bracket to help support and hold the box when attached. It should also be understood that the support devices 52 can be arranged to be positioned under the lock brackets 42 so that they both support the cabinet device 10.

In view of the foregoing description, it can thus be appreciated that the present invention makes available a security device that can provide for protecting boxes contained with important materials.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. A securing device for a box comprising:

a cabinet means defining an enclosure for safekeeping a bottom portion of a box containing valuables;

said cabinet means including side walls, a rear wall, a front wall, a bottom base and an open top section into which the box bottom portion may be inserted thereinto; means for securing the bottom base to a floor section; and means for securing the box within said cabinet device means; and a drawer means which is removably securable in and out of an opening of the front wall.

2. A securing device for a box comprising:

a cabinet device for receiving a bottom portion of the box, said cabinet device having side walls, a rear wall, a forward wall and a bottom base;

said cabinet device including means for releasably securing the box within an upper section of said cabinet device;

a support device means for securing the bottom portion of the box within the cabinet device upper sectionl;

said forward wall including an open area to receive a drawer means inserted into the open area of the forward wall;

said drawer means being provided with locking means and having a front end;

said bottom base having means for allowing said cabinet device to be secured onto a supporting surface; and said locking means being on the drawer means front end for releasably locking the drawer means within said cabinet device.

3. The securing device for a box according to claim 2 wherein said means for securing the bottom portion of the box within the upper section of said cabinet device includes L-brackets, each L-bracket having a vertical section, which is attached to inner sides of the cabinet device walls, and an upper horizontal section upon which the bottom portion of the box is attached.

4. The securing device for a box according to claim 3 further including support devices attached to the sides and front and rear corners of the cabinet walls with a height equal to the horizontal section of the L-brackets to thereby assist in supporting the box when attached to the horizontal section of the L-brackets.

5. The securing device for a box according to claim 2 wherein said means for securing the cabinet device onto a supporting surface comprises lag bar means extending across the inner bottom portion of the cabinet device from the inner front wall to the inner rear wall and bolt means which attach the lag bar to the support surface.

6. A securing device for a box comprising:

a cabinet device for receiving a bottom portion of the box, said cabinet device having side walls, a rear wall, a forward wall and a bottom base;

said cabinet device including means for releasably securing the box within an upper section of said cabinet device;

said means for securing the bottom portion of the box within the upper section of said cabinet device includes L-brackets, each L-bracket having a vertical section, which is attached to inner sides of the cabinet device walls, and a horizontal section upon which the bottom portion of the box is attached;

support devices attached to the corners of the cabinet walls with a height equal to the horizontal section of the L-brackets to thereby assist in supporting the box when attached to the horizontal section of the L-brackets;

said forward wall including an open area to receive a drawer means inserted into the open area of the forward wall, where said drawer means includes a front end;

locking means being on the drawer means front end for releasably locking the drawer means within said cabinet device; and means for allowing said cabinet device to be secured onto a supporting surface.

7. The securing device for a box according to claim 6 wherein said means for securing the cabinet device onto a supporting surface comprises lag bar means extending across the inner bottom portion of the cabinet device from the inner front wall to the inner rear wall and bolt means which attach the lag bar to the support surface.

* * * * *